United States Patent [19]

Ikeda

[11] 4,396,870

[45] Aug. 2, 1983

[54] ELECTRONIC FLASH DEVICE

[75] Inventor: Takahiro Ikeda, Osaka, Japan

[73] Assignee: West Electric Co., Ltd.

[21] Appl. No.: 276,882

[22] Filed: Jun. 24, 1981

[30] Foreign Application Priority Data

Jul. 1, 1980 [JP] Japan ..... 55-90286

[51] Int. Cl.[3] ..... H05B 41/32

[52] U.S. Cl. ..... 315/241 P; 315/135; 315/219

[58] Field of Search ..... 315/134–136, 315/151, 219, 224, 241 P, 278; 320/1; 354/145, 127

[56] References Cited

U.S. PATENT DOCUMENTS 4,068,150 1/1978 Iwata et al. ..... 315/241 P 4,197,484 4/1980 Tanaka ..... 315/135 X 4,301,392 11/1981 Hirata ..... 315/136 X

*Primary Examiner*—Eugene R. La Roche

*Attorney, Agent, or Firm*—Burgess, Ryan and Wayne

[57] ABSTRACT

An electronic flash device provided with an auxiliary winding electromagnetically coupled to a winding in a DC-DC converter which is connected to a main power supply and generates a voltage for charging a main flash capacitor, an auxiliary capacitor adapted to be charged with at least the voltage induced across the auxiliary winding, and a control circuit for maintaining the voltage charged across the auxiliary capacitor at a predetermined level, whereby the voltage charged across the auxiliary capacitor can be delivered to integrated circuits for the flash device.

7 Claims, 9 Drawing Figures

ELECTRONIC FLASH DEVICE

BACKGROUND OF THE INVENTION

The present invention relates to an electronic flash device.

Recently developed electronic flash devices uses many integrated circuits in a display device for displaying that a main flash capacitor has been charged to a predetermined level so that a flash lamp is ready to be lighted or that an electronic flash device is set in the automatic mode. These integrated circuits are used in order to make the electronic flash device compact in size and light in weight and to attain the reduction in costs. In order to operate them, there have been devised and demonstrated various types of power supplies.

In a prior art electronic flash device, the auxiliary power for integrated circuits is derived through a transformer from a charging circuit for charging a main flash capacitor. As a result, the voltage of the auxiliary power supply rises and drops with rise and drop in voltage charged across the main flash capacitor. Therefore, immediately after starting the charging of the main flash capacitor or immediately after the flash lamp has been lighted, the voltage of the auxiliary power supply drops below a predetermined minimum level below which the integrated circuits cannot operate normally.

SUMMARY OF THE INVENTION

The present invention relates to an electronic flash device. The electronic flash device in accordance with the present invention is featured by having an auxiliary winding electromagnetically coupled to a winding in a DC-DC converter which in turn is connected to a main power supply and generates a voltage for charging a main flash capacitor, an auxiliary capacitor so inserted that it can be charged with at least a voltage induced across the auxiliary winding and a control circuit for maintaining the voltage charged across the auxiliary capacitor at a predetermined level. The voltage charged across the auxiliary capacitor is delivered to integrated circuits for the flash device.

The present invention provides an electronic flash device with a power supply device or stage in which an auxiliary winding has such a number of coils that even when flash lamp is lighted, the voltage charged across an auxiliary capacitor can be avoided from dropping below a level below which associated integrated circuits cannot operate normally; and in which a voltage control circuit detects the voltage across the auxiliary capacitor which rises when the flash lamp is not turn on and maintains it at a predetermined level.

The above and other objects, effects and features of the present invention will become more apparent from the following description of preferred embodiments thereof taken in conjunction with the accompanying drawings.

BRIEF DESCRIPTION OF THE DRAWINGS

Same reference numerals are used to designate similar parts throughout the figures.

DETAILED DESCRIPTION OF THE PRIOR ART

Figure 1:
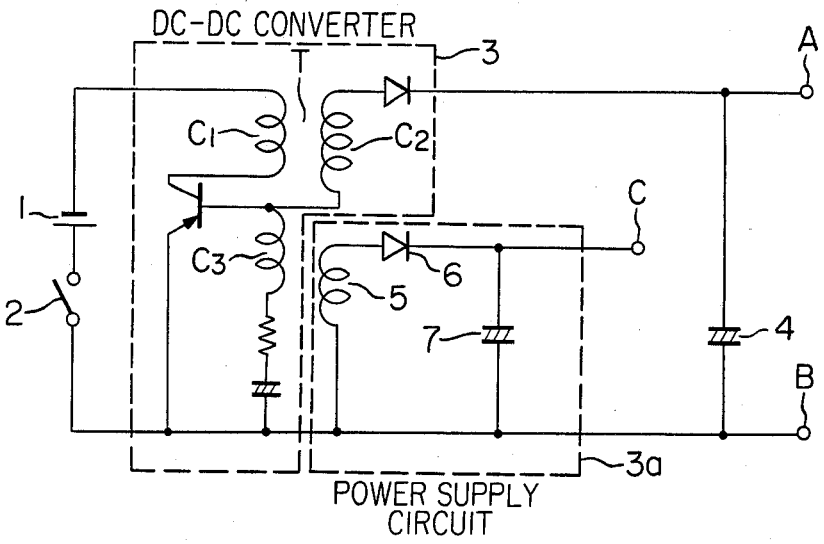
FIG. 1 PRIOR ART
FIG. 1 is a circuit diagram of a power supply stage of a prior art electronic flash device.

In FIG. 1 is shown a power supply of a prior art electronic flash device. A low-voltage main power supply 1 is connected through a switch 2 to a DC-DC converter 3 which steps up the low voltage supplied from the main power supply 1 so as to charge a main flash capacitor 4.

For an IC (integrated circuit) power supply of the type described, a power supply circuit 3*a* comprising an auxiliary winding 5, a diode 6 and an auxiliary capacitor 7 is provided.

A flash lamp (not shown) is connected between terminals A and B and an IC is connected between terminals C and B.

Next, the mode of operation of the power supply for the IC will be described. Since the auxiliary winding 5 is electromagnetically coupled to the windings $C_1$ to $C_3$ of an oscillation transformer T in the DC-DC converter 3, as the main flash capacitor 4 is charged, the voltage across the windings $C_1$ to $C_3$ rises and subsequently the voltage across the auxiliary winding 5 rises. The voltage across the auxiliary winding 5 is delivered through the diode 6 to the auxiliary capacitor 7 and the voltage charged across the auxiliary capacitor 7 is used for driving the IC.

Figure 2:
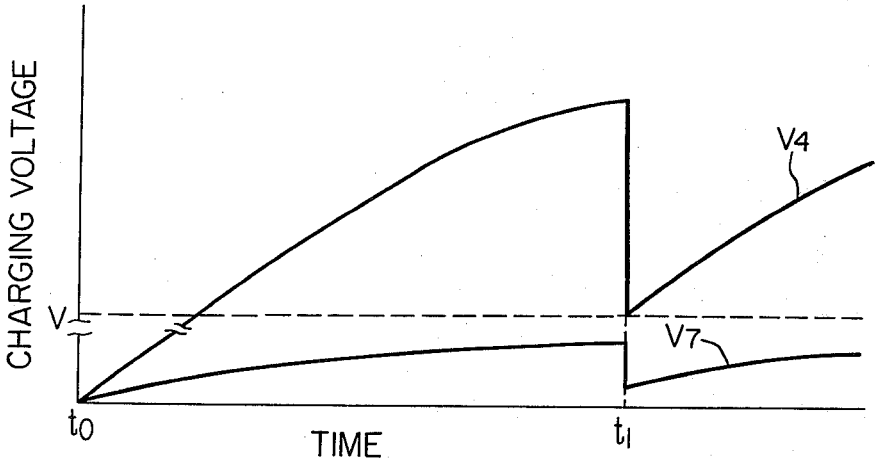
FIG. 2 PRIOR ART
FIG. 2 shows the charging characteristic curves of a main flash capacitor and an auxiliary capacitor thereof.

FIG. 2 shows the charging characteristic curves of the voltage $V_4$ across the main flash capacitor 4 and the voltage $V_7$ across the auxiliary capacitor 7. The switch 2 is closed at $t_0$ and the flash lamp (not shown) is lighted at $t_1$. At $t_1$ both the voltages $V_4$ and $V_7$ suddenly drop and it is apparent that the voltage $V_7$ rises with rise of the voltage $V_4$ across the main flash capacitor 4.

The IC which is connected between the terminals C and B can properly operate only at a predetermined voltage range, so that it is preferable that the voltage $V_7$ across the auxiliary capacitor 4 be maintained within the predetermined range. However, in the prior art power supply device as shown in FIG. 1, the rise and fall of the voltage $V_7$ across the auxiliary capacitor 7 follows that of the voltage $V_4$ across the main flash capacitor 4 as described above and shown in FIG. 2. It follows, therefore, that there is a fear that the voltage $V_7$ drops below a minimum operating level at $t_1$ when the flash lamp is lighted and consequently the IC may not be supplied with a suitable voltage.

One solution to this problem is to increase the number of coils of the auxiliary winding 5 so that a higher voltage may be induced across it. However, there arises another problem that if the flash lamp is not lighted, the voltage $V_7$ across the auxiliary capacitor 7 rises and exceeds a maximum operating level of the IC.

DESCRIPTION OF THE PREFERRED EMBODIMENTS

Figure 3:
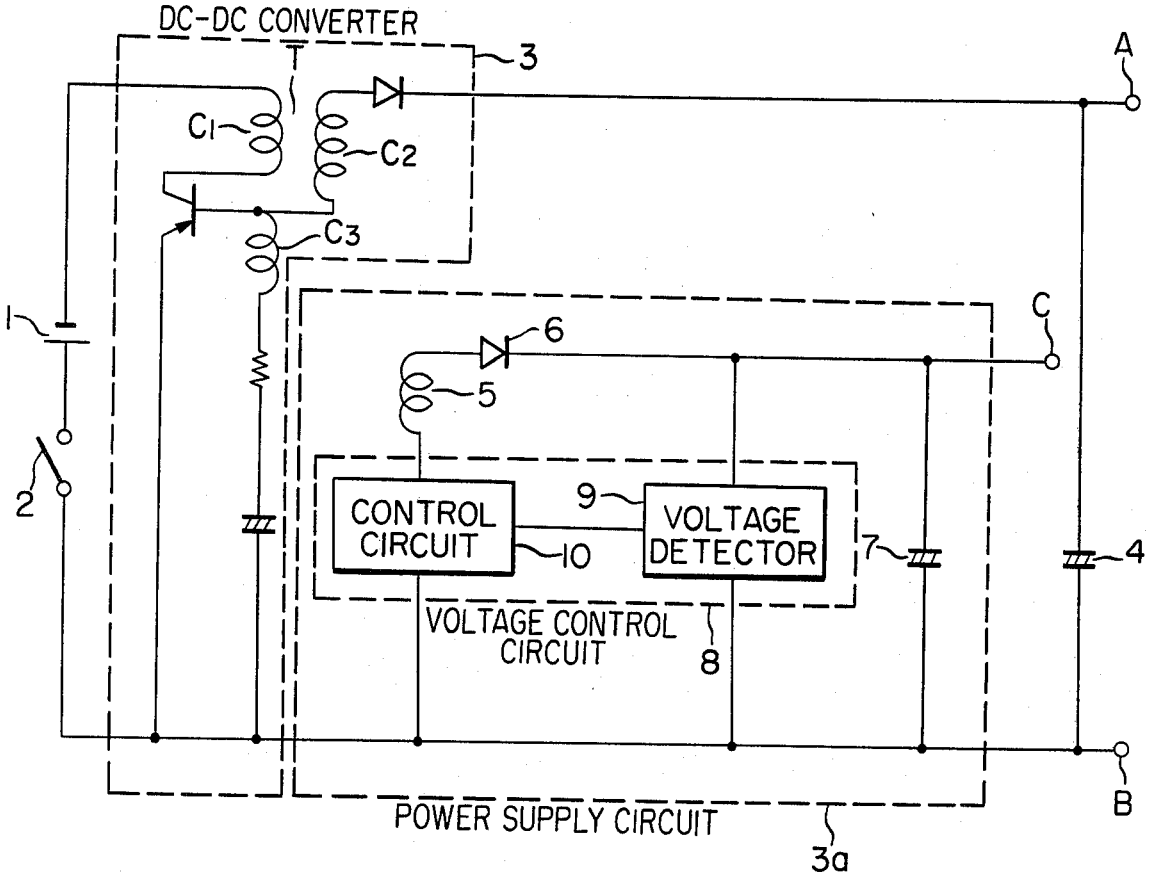
FIG. 3 is a circuit diagram of a first embodiment of the present invention.

In FIG. 3 is shown a first embodiment of the present invention; that is, a power supply stage. It includes a voltage control circuit 8 comprising a voltage detector 9 for detecting the voltage between the terminals C and B and a control circuit 10 for controlling the degree of electromagnetic coupling between the auxiliary winding 5 and the windings $C_1$ to $C_3$ of the transformer T.

As with the prior art power supply stage as shown in FIG. 1, when the switch 2 is closed, the low voltage is delivered to the DC-DC converter 3, so that the main flash capacitor 4 and the auxiliary capacitor 7 are charged. According to the first embodiment, however, the number of coils of the auxiliary winding 5 is greater than that of the auxiliary winding shown in FIG. 1, the voltage $V_7$ rises faster than the voltage across the auxiliary winding 5 shown in FIGS. 1 and 2.

The voltage detector 9 detects whether or not the voltage $V_7$ across the auxiliary capacitor 7 reaches a predetermined level at and above which the IC can operate normally. In response to the output from the voltage detector 9 representing that the voltage $V_7$ reaches a predetermined level, the control circuit 10 is activated so as to decouple the auxiliary winding 5 from the windings $C_1$ to $C_3$ of the transformer T. As a consequence, no voltage is induced across the auxiliary winding 5 so that the charging of the auxiliary capacitor 7 is interrupted and the voltage $V_7$ thereacross is maintained at a predetermined level.

Figure 4:
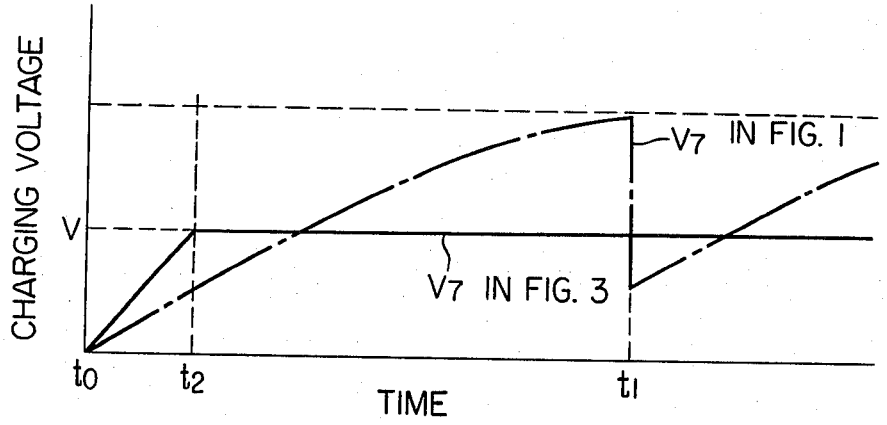
FIG. 4 shows the charging characteristic curve of an auxiliary capacitor thereof.

The charging characteristic curve of the auxiliary capacitor 7 of the first embodiment is shown in FIG. 4 in contrast with the characteristic curve of the auxiliary capacitor shown in FIG. 2. The voltage $V_7$ almost linearly rises from $t_0$ to $t_2$, but after $t_2$ the voltage $V_7$ across the auxiliary capacitor 7 is maintained at a predetermined voltage V. That is, opposed to the prior art power supply stage as shown in FIG. 2 in which the voltage $V_7$ across the auxiliary capacitor 7 keeps rising until $t_1$ when the flash lamp is lighted, according to the first embodiment of the present invention, the voltage $V_7$ across the auxiliary capacitor 7 is maintained at a constant voltage V after $t_2$. Since the number of coils of the auxiliary winding 5 is increased considerably as described previously, even when and after the flash lamp is lighted at $t_1$, the voltage $V_7$ across the auxiliary capacitor 7 is maintained unchanged as shown in FIG. 4. That is, according to the first embodiment, the number of coils of the auxiliary winding 5 is so increased that even when the flash lamp is lighted, the voltage across the auxiliary winding 5 will not drop below the voltage V and except the time when the flash lamp is lighted, the voltage $V_7$ across the auxiliary capacitor 7 is maintained at a predetermined voltage V, at which the IC can operate normally, by the voltage detector 9 and the control circuit 10.

Figure 5:
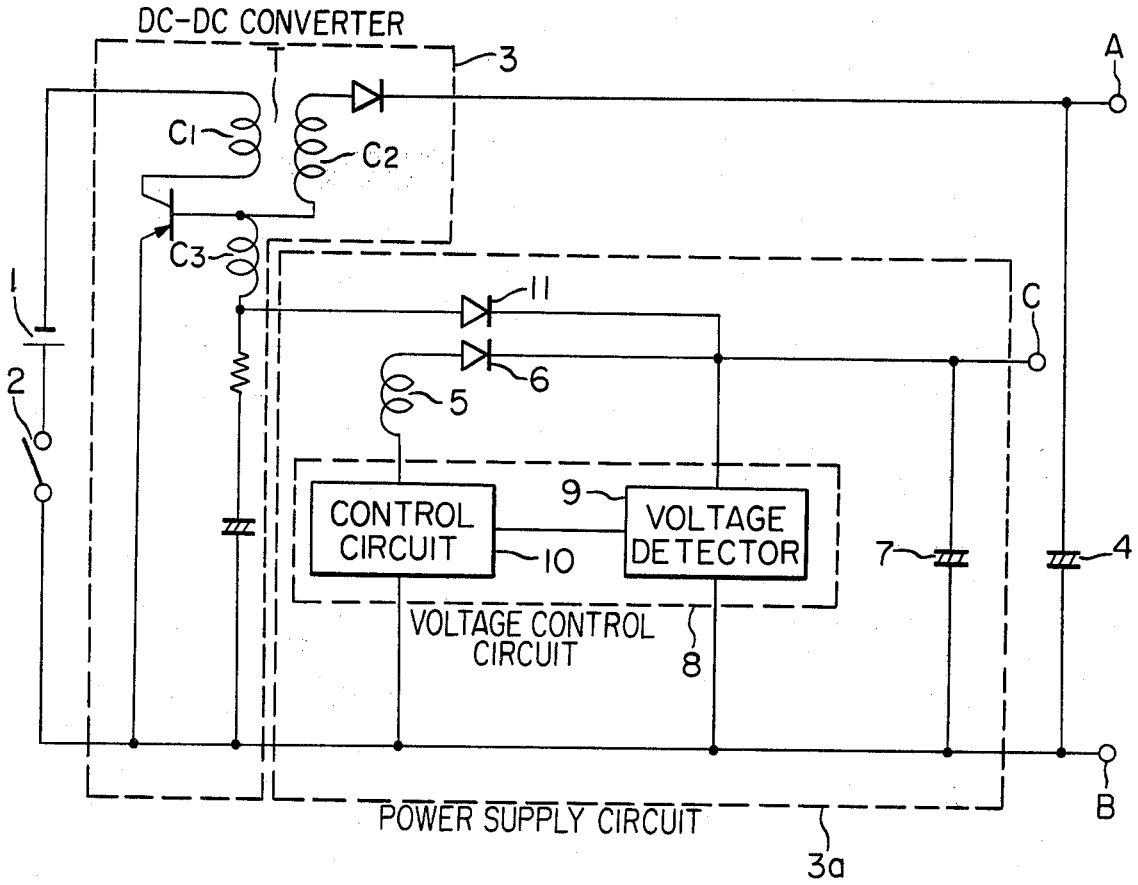
FIG. 5 is a circuit diagram of a second embodiment of the present invention.
Figure 6:
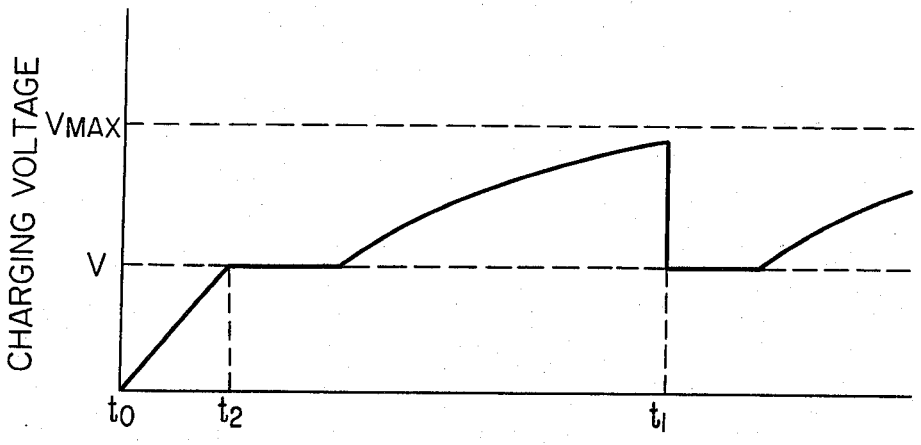
FIG. 6 shows the charging characteristic curve of an auxiliary capacitor thereof.

In FIG. 5 is shown a second embodiment of the present invention; that is, a power supply stage. The second embodiment is substantially similar in construction to the first embodiment as shown in FIG. 3 except that the DC-DC converter 3 is connected through a diode 11 to the auxiliary capacitor 7. Therefore, the power supply for the IC utilizes not only the voltage $V_7$ induced across the auxiliary winding 5 but also a voltage generated in the DC-DC converter 3. Therefore, the voltage across the auxiliary capacitor 7 changes as shown in FIG. 6.

Since the voltage generated in the DC-DC converter 3 is utilized, even if the number of coils of the auxiliary winding 5 is decreased as compared with the first embodiment shown in FIG. 3, the supply of a predetermined voltage to the IC can be ensured. As a result, the power efficiency can be considerably improved.

Figure 7:
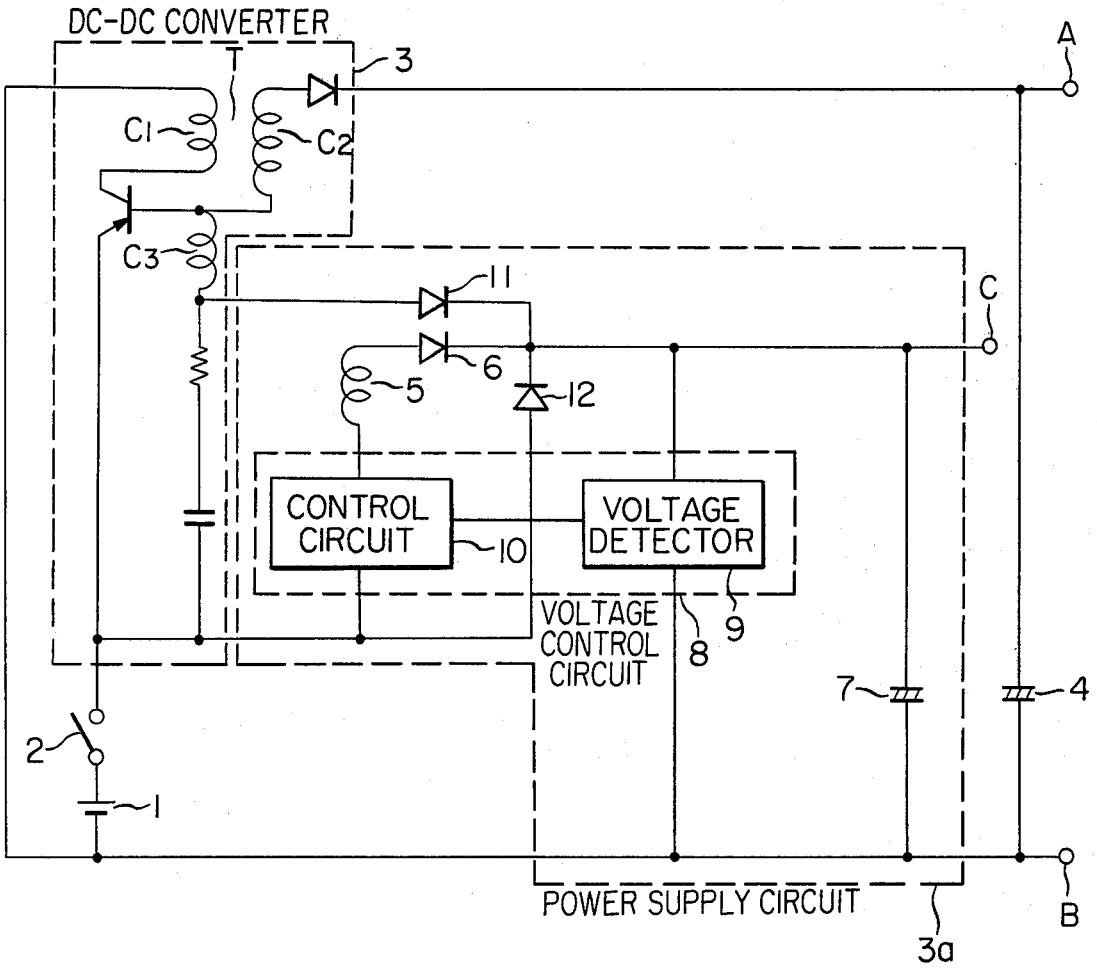
FIG. 7 is a circuit diagram of a third embodiment of the present invention.
Figure 8:
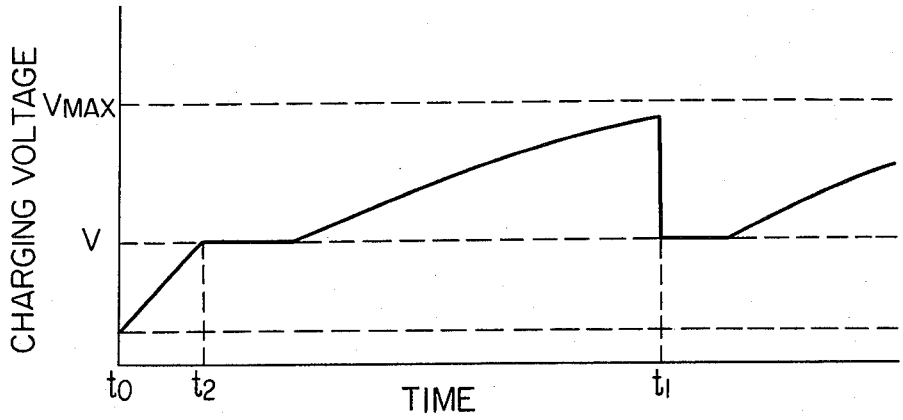
FIG. 8 shows the charging characteristic curve of an auxiliary capacitor thereof.

In FIG. 7 is shown a third embodiment of the present invention which is substantially similar in construction to the second embodiment shown in FIG. 5 except that a diode 12 is added, so that the voltage across the low-voltage power supply 1 can be used for charging the auxiliary capacitor 7. The charging characteristic curve of the capacitor 7 is shown in FIG. 8. Since the voltage of the low-voltage power supply 1 is used for charging the auxiliary capacitor 7, the number of coils of the auxiliary winding 5 can be further reduced. In addition, the power efficiency can be further improved and the stable supply of the voltage to the IC can be ensured.

Figure 9:
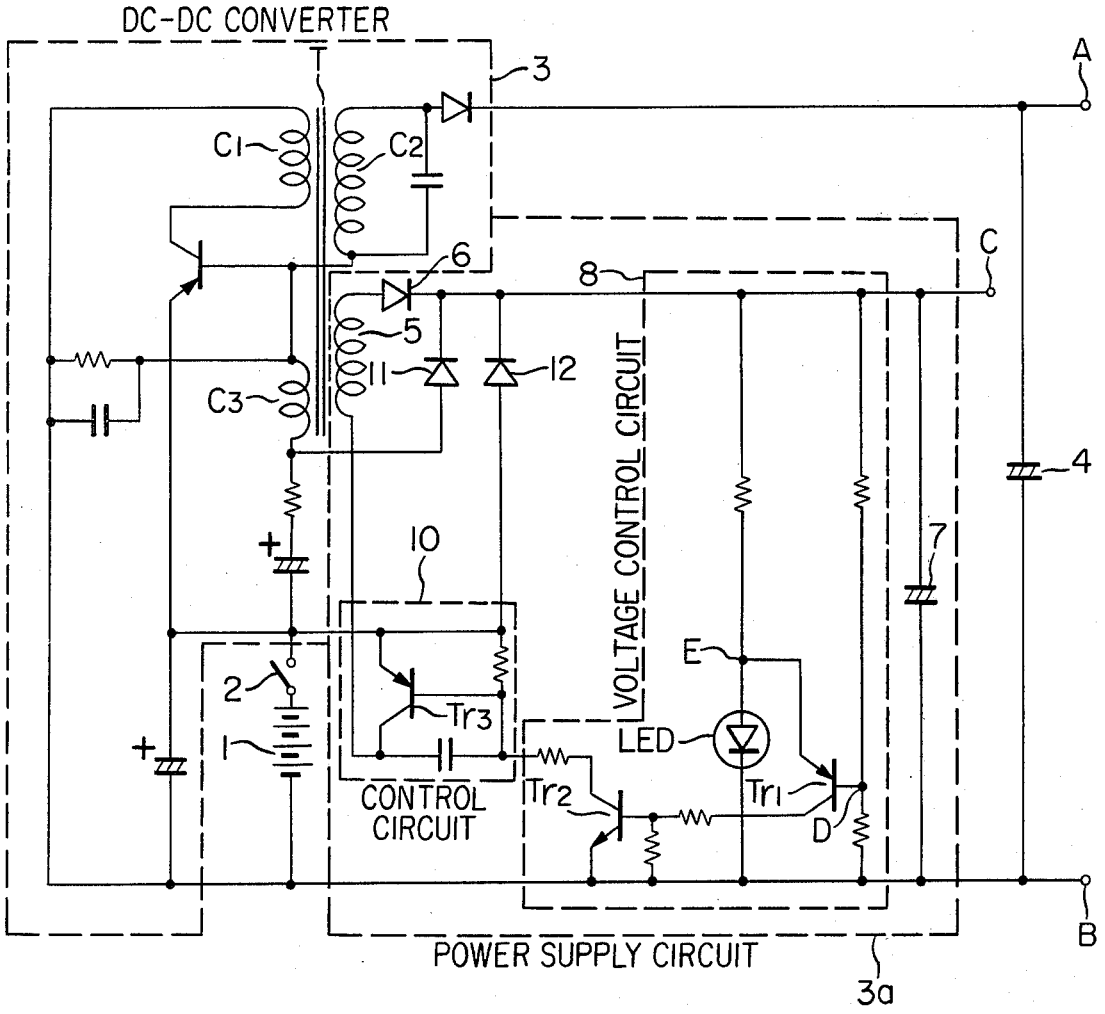
FIG. 9 is a detailed circuit diagram of the third embodiment shown in FIG. 7.

The third embodiment is shown in more detail in FIG. 9. When the switch 2 is closed, the voltage is delivered from the low-voltage power supply 1 to the DC-DC converter 3 and across the emitter and base of a transistor $Tr_1$ through the diode 12, so that the transistor $Tr_1$ is turned on. Then, the voltage of the main power supply 1 is applied across the base and emitter of a transistor $Tr_2$ through the diode 12 and the transistor $Tr_1$ so that the transistor $Tr_2$ is also turned on. Then, the base current is supplied from the low-voltage main power supply 1 to a transistor $Tr_3$, so that $Tr_3$ is turned on and the auxiliary winding 5 is electromagnetically coupled to the windings $C_1$ to $C_3$ of the transformer T. The voltage induced across the auxiliary winding 5 causes a current to flow through the diode 6, the auxiliary capacitor 7, the main power supply 1 and the transistor $Tr_3$, whereby the auxiliary capacitor 7 is charged.

The voltage $V_D$ at a point D rises with increase in voltage across the auxiliary capacitor 7, but the voltage $V_E$ at a point E will not rise beyond a predetermined level because of the insertion of a light-emitting diode LED. As a result, only when the voltage $V_E$ is higher than $V_D$ plus $V_{BE}$ (the base-to-emitter voltage of the transistor $Tr_1$), the transistor $Tr_1$ is kept turned on, but it is turned off when $V_E<(V_D+V_{BE})$. Immediately after the switch 2 is closed, the auxiliary capacitor 7 is not charged, so that the relation $V_E>(V_D+V_{BE})$ is maintained. Thereafter, the auxiliary capacitor 7 is charged in the manner described above and when the voltage $V_D$; that is, the voltage across the capacitor 7 divided by resistors as shown, becomes greater than $(V_E-V_{BE})$, the transistor $Tr_1$ is turned off. As a consequence, the transistors $Tr_2$ and $Tr_3$ are also turned off and consequently the electromagnetic coupling of the auxiliary winding 5 with the tertiary winding $C_3$ is disconnected. LED is used as a constant voltage regulator, so that the voltage $V_E$ at the point E is maintained at, for instance, 1.8 V. Instead of LED, any other suitable voltage regulator may be used.

The charging characteristic curve of the auxiliary capacitor 7 is shown in FIG. 8.

If the power supply stage shown in FIG. 9 is so designed that when the auxiliary winding 5 is decoupled from the windings $C_1$ to $C_3$, the voltage $V_E$ between the terminals C and B can be maintained at a level for enabling the normal operation of the IC, the stabilized voltage supply to the IC can be ensured.

In summary, as described above, the present invention provides an electronic flash device which has the auxiliary power supply which in turn ensures the stabilized supply of power to the IC associated with the electronic flash device.

What is claimed is:

1. An electronic flash device of the type in which an auxiliary winding is electromagnetically coupled to a winding in a DC-DC converter for charging a main flash capacitor and an auxiliary capacitor is charged with the voltage induced across said auxiliary winding through a diode so that the voltage across said auxiliary capacitor can be used as an auxiliary power supply, characterized by the provision of a voltage control circuit comprising a voltage detector for detecting the voltage across said auxiliary capacitor, and a control circuit which is connected in series to said auxiliary winding and which is adapted to decouple of said auxiliary winding from said winding in said DC-DC converter in response to the output signal from said voltage detector, whereby the voltage across said auxiliary capacitor can be controlled as desired.

2. An electronic flash device as set forth in claim 1 further characterized in that said auxiliary capacitor is connected through a second diode to said DC-DC converter so that said auxiliary capacitor can be also charged with a voltage generated in said DC-DC converter.

3. An electronic flash device as set forth in claim 1 or 2 further characterized in that said auxiliary capacitor is connected through a third diode to a main power supply for said DC-DC converter so that said auxiliary capacitor can be also charged with a voltage of said main power supply.

4. An electronic flash device as set forth in claim 1 further characterized in that said voltage detector comprises a first transistor adapted to detect the voltage being charged across said auxiliary capacitor in terms of a voltage across a resistor connected in parallel with said auxiliary capacitor, and a second transistor which is controlled by said first transistor so as to control said control circuit.

5. An electronic flash device as set forth in claim 1 further characterized in that said voltage detector includes a constant-voltage regulator.

6. An electronic flash device as set forth in claim 1 further characterized in that said control circuit includes a transistor.

7. An electronic flash device as set forth in claim 1 further characterized in that said auxiliary power supply is used for supplying power to one more ICs.

* * * * *